United States Patent [19]

Kroon

[11] 4,224,491

[45] Sep. 23, 1980

[54] CHEMICALLY ACTIVATED SWITCH

[75] Inventor: Peter J. Kroon, Swarthmore, Pa.

[73] Assignee: Electric Power Research Institute, Inc., Palo Alto, Calif.

[21] Appl. No.: 887,172

[22] Filed: Mar. 16, 1978

[51] Int. Cl.[2] ..... H01H 33/68

[52] U.S. Cl. ..... 200/150 R; 200/150 G; 337/401

[58] Field of Search ..... 200/150 G, 150 R, 61.08; 337/401; 102/263; 137/68 A

[56] References Cited

U.S. PATENT DOCUMENTS

| | | | |
|---|---|---|---|
| 2,931,874 | 4/1960 | Leaman | 102/263 |
| 3,264,438 | 8/1966 | Gay | 200/61.08 |
| 3,548,848 | 12/1970 | Stichling | 137/68 A |
| 3,909,676 | 9/1975 | McConnell | 200/144 AP |

OTHER PUBLICATIONS

Fuji Publication EEC65, "Fuji Indoor Use Fuse", Fuji Electric Co., Ltd.

*Primary Examiner*—Harold Broome

*Attorney, Agent, or Firm*—Flehr, Hohbach, Test, Albritton & Herbert

[57] ABSTRACT

A switch is provided for use in controlling currents associated with power line faults. The switch includes a housing with a pair of relatively movable electrodes opened and closed by means of chemical propellants. In the preferred form, one electrode comprises a movable contact slidably disposed in a support cylinder within the housing and the other electrode is fixed. The sliding contact is movable into a closed position in which the electrodes are in mutual contact. A first chemical propellant charge disposed in the support cylinder drives the contact into the closed position. A chamber for holding dielectric fluid is disposed in the housing and extends through an opening in the fixed electrode. A second propellant charge is located behind a piston in the chamber. When in the closed position, the contact blocks and closes the opening in the electrode, thus closing the chamber. Upon detonation of the second propellant charge, the piston is driven against the fluid in the tube, driving the contact into the open position.

22 Claims, 7 Drawing Figures

CHEMICALLY ACTIVATED SWITCH

BACKGROUND OF THE INVENTION

This invention relates to switches of the type used in controlling fault currents associated with transmission lines in power distribution systems. More particularly, the invention relates to such switches employing chemical propellant actuators.

Fast acting switches are used on power distribution lines for current limiting purposes. Fault currents on high voltage lines, due to ground shorts, for example, can rapidly become enormous and cause serious equipment damage. As transmission voltages rise there is a continuing need in the electric power industry for improved current interrupting switches for use in rapidly controlling fault currents.

Current limiting circuits employ switches which open to divert a fault current through an associated current-suppressive impedance which limits the current to a safe level. Preferably, the circuit is re-established, as rapidly as possible after the source of the fault is eliminated. In the case of short-lived fault sources such as lightning bolts, the opening and closing of interrupter switches is preferably handled automatically. The switches, therefore, should be rapidly responsive to automatic signals, and should produce a large voltage drop sufficient to divert the fault current through the associated protective impedance.

Chemically activated interrupter switches such as those described in application Ser. No. 889,491, filed Mar. 22, 1978, assigned to the assignee of the present invention, provide both rapid contact separation and large voltage drops. As noted above, however, it is desirable to also provide for automatic reclosing of the circuit after the fault has cleared. mechanical deviced for opening and closing switches are generally expensive and are unable to operate with the rapidity desired. Furthermore, switch contacts opened and closed by mechanical actuators generally produce undesirable contact bounce.

OBJECTS AND SUMMARY OF THE INVENTION

It is an object of the invention to provide a switch for use in a current limiting circuit which is closed and opened by means of chemical propellants.

Another object of the invention is to provide such a switch which rapidly produces a large voltage drop between the electrodes upon opening.

Another object of the invention is to provide such a switch which can be reused with a minimum of reconstruction.

Accordingly, a chemically activated switch is provided for use in controlling currents associated with power line faults. The switch includes a housing, and a pair of relatively movable electrodes in the housing. The electrodes are relatively movable between a closed position in which the electrodes are in mutual contact and an open position in which the electrodes are separated. The housing includes first and second propellant receiving means. The first propellant receiving means is disposed to drive the electrodes into their closed position upon detonation of a chemical propellant in the first receiving means. The second propellant receiving means is disposed to drive the electrodes into their open position upon detonation of a chemical propellant in the second receiving means.

DESCRIPTION OF THE PREFERRED EMBODIMENT

Figure 1:
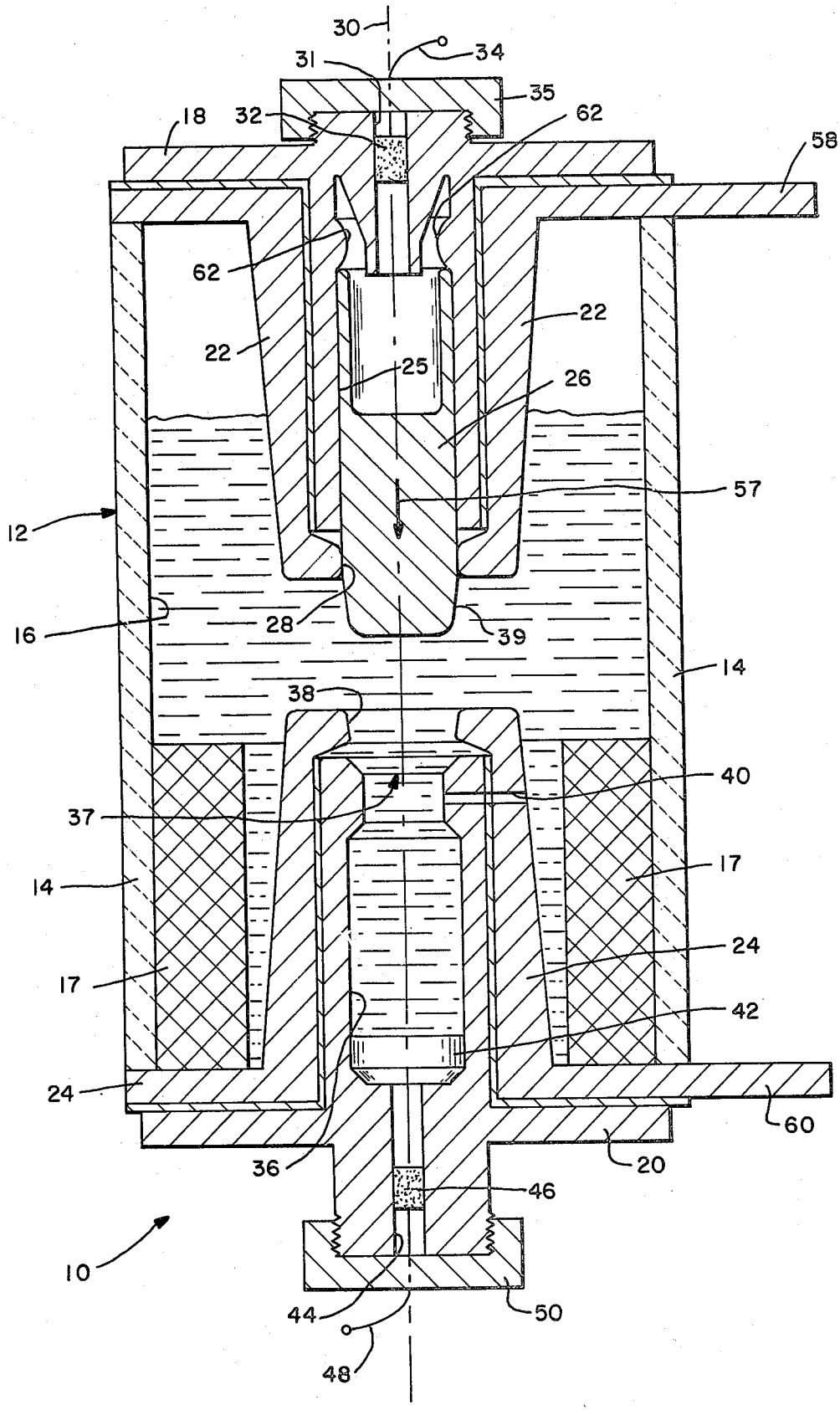
FIG. 1 is a cross-sectional view of a switch according to the invention.
Figure 2:
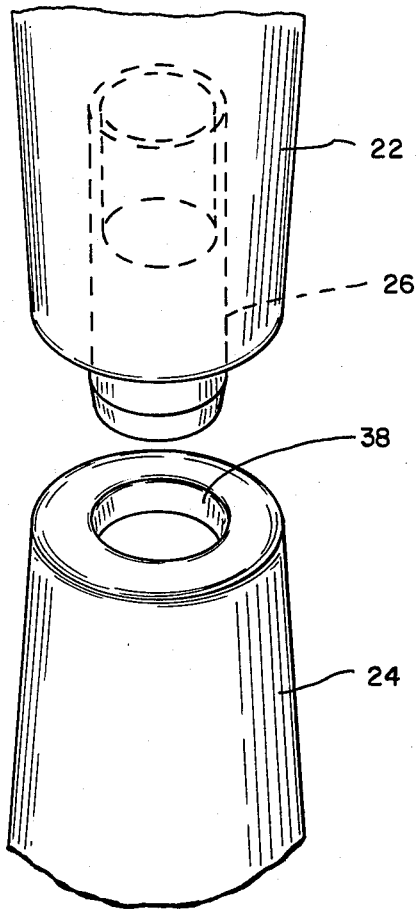
FIG. 2 is a perspective view of the electrodes of the switch shown in FIG. 1.

Referring to FIG. 1, a first embodiment of a switch 10 according to the invention is shown with a housing 12 having side walls 14 formed of a suitable insulating material such as fiberglass or ceramic. Side walls 14 are substantially cylindrical, and enclose a cylindrical interior space 16 filled with a suitable dielectric fluid such as oil or liquid sulfur hexaflouride ($SF_6$). Resilient foam members 17 absorb increases in fluid volume within space 16. Foam members 17 can be formed of a closed-cell polyurethane material. Supported from end walls 18 and 20 of the housing are a pair of electrode members 22 and 24, respectively. The central portions of the electrodes are substantially cylindrical, as shown most clearly in FIG. 2.

Upper electrode 22 substantially surrounds a support cylinder 25 in which a movable contact member 26 is slidably supported. Contact 26 extends through an opening 28 in the lower end of electrode 22 and is movable to open and close switch 10. The open position of contact 26 is shown in FIG. 1 in which the contact 26 is separated from electrode 24. Contact 26 is also slidable to a closed position shown in FIG. 3, in which contact 26 is in contact with electrode 24. At all times, contact 26 remains in electrical contact with electrode 22. Thus, contact 26 forms a movable portion of electrode 22 supported for movement along an axis of movement 30 substantially coaxial with the axis of cylindrical housing 12.

Because electrode 22 and contact 26 remain in continuous conductive contact, they function together as a single movable electrode. As such electrode 24 and the combination of electrode 22 and contact 26 together form a pair of relatively movable electrode members in housing 12. Movable contact 26 permits the electrodes to be moved between their respective open and close positions shown in FIGS. 1 and 3, respectively.

At the upper end of support cylinder 25 is a first propellant receiving means 31 in which is provided a first chemical explosive of a type which can be readily detonated by a signal on wire 34, extending through housing cap 35. An example of such an explosive would be a firing cap. Cylinder 25 is isolated from the remaining interior 16 of the housing and is filled with air or another suitable gas forming a mdeium for transmitting motive force from charge 32 to contact 26.

Figure 3:
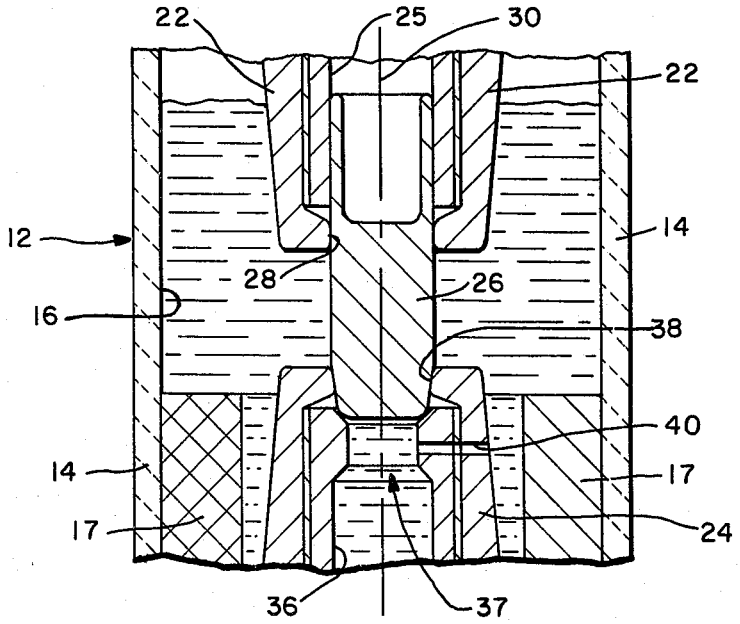
FIG. 3 is a partial cross-sectional view of the switch shown in FIG. 1 on a reduced scale with the electrodes in the closed position.

The central portion of lower electrode 24 substantially surrounds means forming a chamber 36 in housing 12. Chamber 36 holds a portion of the dielectric fluid which fills the interior 16 of the housing. Chamber 36 extends adjacent electrode 24 and has an opening 37 which extends through an opening 38 in the top of electrode 24. When contact member 26 is in the closed position, as shown in FIG. 3, the contact member extends into opening 38 blocking and closing opening 37 so that the dolumn of oil in chamber 36 is directly adjacent the contact member. Both opening 38 and side portions 39 of contact 26 are slightly tapered to allow oil to escape as the contact is moved into the closed position. A small passage 40 is provided through electrode 24 to permit additional oil to escape during contact closure. In the lower end of chamber 36 is a first movable piston 42. Behind piston 42 is a second propellant receiving means 44 containing a second chemical propellant charge 46 for driving piston 42 against the fluid in chamber 36. The propellant charge 46, is larger than the first charge 32 at the upper end of the switch so as to provide a substantially larger driving force to open the switch than to close the switch. The fluid in chamber 36 is also a more effective medium for transmitting motive force from charge 46 to contact 26 than is the gas in cylinder 24. Detonation wire 48 extends through housing cap 50.

Both propellant charges 32 and 46 are disposed along the axis of movement 30 on opposite sides of contact 26. Thus, the charges can drive contact 26 in either direction along axis 30 to open and close the switch.

Figure 4:
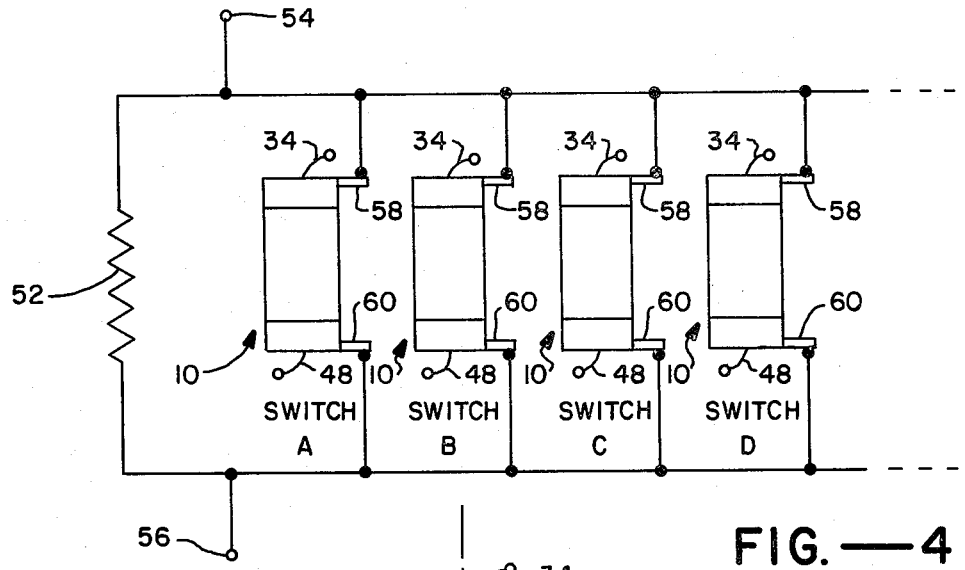
FIG. 4 is a circuit diagram showing the external connections for a plurality of switches of the type shown in FIG. 1.

Use of the first embodiment switch 10 is illustrated in FIG. 4. A plurality of the switches are installed in parallel with a suitable current-suppressive impedance on line in a power distribution system. In FIG. 4, element 52 represents the current-suppressive impedance. The power line is connected between points 54 and 56. Prior to use, all but one of the switches 10 are in the mode shown in FIG. 1, with contact 26 in the open position. Protruding portions 58 and 60 of electrodes 22 and 24, respectively, are connected to the power line, as shown in FIG. 4. Detonation wires 34 and 48 are connected to a line-monitoring actuating means (not shown) which monitors the power line current and sequentially activates the switches.

During normal current levels, one switch, for exmple Switch A, will have closed contacts as shown in FIG. 3 and will carry the line current. When a rapid rise in current on the line indicates a line fault, the previously-mentioned actuating means sends a detonation signal over line 48 to Switch A causing chemical propellant charge 46 to ignite. The resultant explosion drives piston 42 against the fluid in chamber 36. The piston causes a tremendous increase in fluid pressure in chamber 36 which forces the contact out of opening 37 by means of fluid pressure, causing the fluid in chamber 36 to enter space 16. Foam members 27 absorb the pressure pulse of the fluid entering interior 16 of the housing. The force of the fluid drives contact 26 upwardly to the position shown in FIG. 5. The separation of contact 26 and electrode 24 causes arcing in the intervening gap. The arc will carry substantially the full fault current until a sufficient voltage drop is developed to divert the current through parallel impedance 52. As described in application Ser. No. 889,491, filed Mar. 22, 1978, this type of switch construction provides for a transverse flow of the dielectric fluid across the arc in the gap separating the electrodes following separation. This transverse flow produces a large voltage drop between the arcing electrodes, rapidly diverting the fault current into the parallel impedance. At the next current zero in the alternating current cycle, the arc is extinguished. The dielectric fluid also helps prevent arc re-ignition. When the arc is extinguished in Switch A, fault current diversion is complete.

Figure 5:
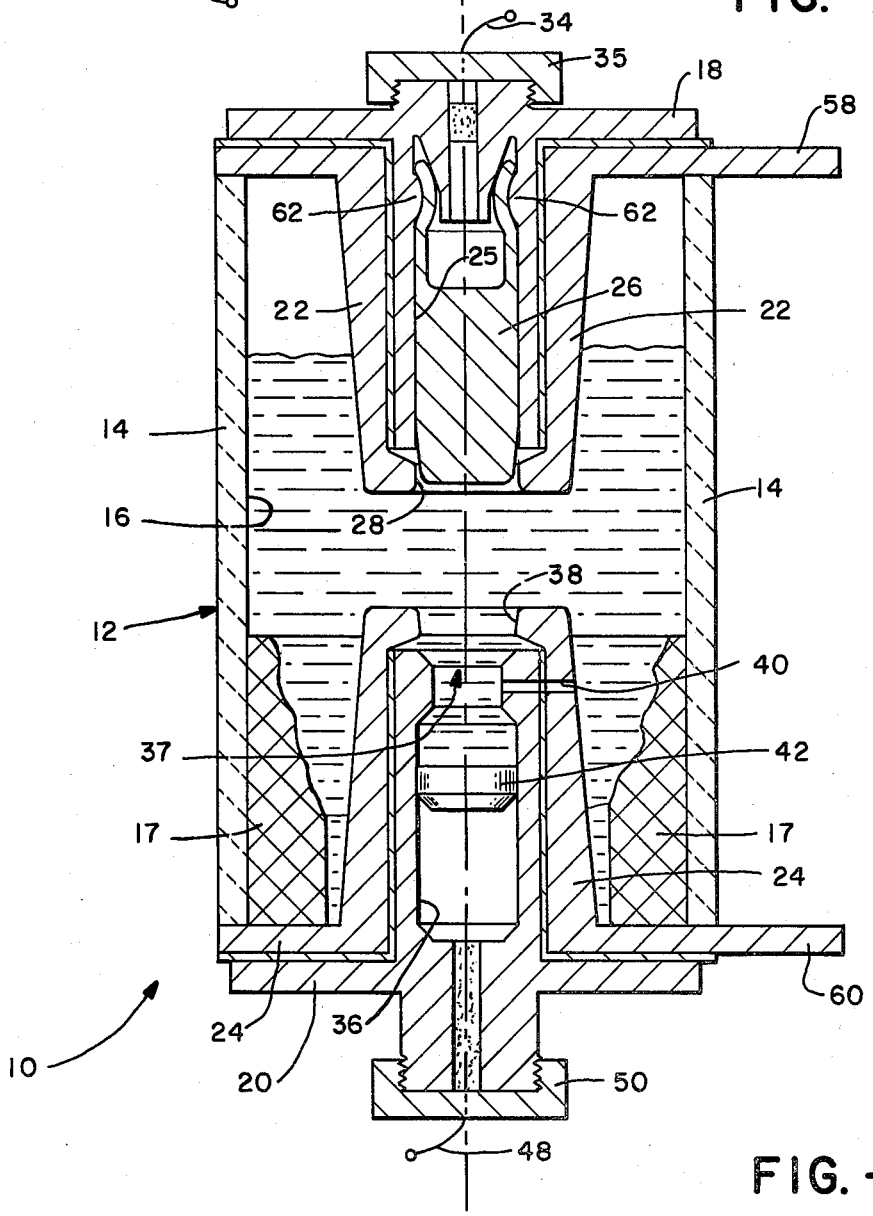
FIG. 5 is a cross-sectional view on a reduced scale of the switch shown in FIG. 1 following detonation of the chemical propellant in the lower propellant receiving means.

When the fault has cleared on the power line, the connection must be reestablished using another parallel switch. The previously-mentioned actuating means first senses the termination of the fault condition and sends a detonation signal to Switch B in FIG. 4, over line 34. Such detonation signal ignites the chemical propellant charge 32 in cylinder 25. The resultant explosion substantially increases the gaseous pressure in cylinder 25, driving contact 26 downwardly, in the direction of arrow 57 in FIG. 1. Contact 26 enters opening 38 in contact 24 and establishes conductive contact between electrodes 22 and 24. The tapered construction of opening 38 and contact 26, as well as passage 40, permit escape of dielectric fluid from chamber 36 to allow the contact to fully seat within the opening. Line current then flows through Switch B until a subsequent fault is detected. When such fault occurs, a signal is sent by the actuator to switch B over wire 48 detonating charge 46 as described above. The larger size of charge 46, and the intervening fluid medium in chamber 36, provide far more powerful driving forces to open the switch than were provided to close the switch. Thus, the opening force successfully overcomes the gaseous pressure in cylinder 25 to drive contact 26 back into the open position as shown in FIG. 5.

Remaining switches C, D, etc., are fired sequentially by the actuating means, which automatically indexes from switch to switch as each is used. In each switch the closing signal over line 34 is given first to plane that switch on the line. When a fault is detected, the opening signal for the appropriate switch is then sent over line 48. Trip-free operation is provided for each switch since no internal resetting is required. The two propellant charges are simply ignited in the proper sequence. Contact 26 is held in its initial open position, as shown in FIG. 1, by frictional engagement with the side walls of cylinder 25. Upon reopening, contact 26 will deform around stops 62 and thereby lock in the open position, as shown in FIG. 5.

As with the current interrupters described in application Ser. No. 889,491, filed Mar. 22, 1978, the switches of the present invention take advantage of the pressure-transmitting properties of the dielectric fluid within the housing. The fluid provides the dual advantages of both efficient pressure transmission and a large fluid cross-flow which helps cool the arcing electrodes and increases the voltage drop produced. The closing propellant charge 32 is relatively fact-acting, and can drive contact 26 into the closed position in approximately 10 to 40 milliseconds. Even faster opening times are provided, with propellant 46 opening the switch within approximately one millisecond after receiving the "open" signal.

It is contemplated that approximately 20 switches will be installed in parallel with the current-suppressive impedance in a single magazine. The switches are reusable after replacement of the two propellant charges and replacement and setting of movable contact 26.

Figure 6:
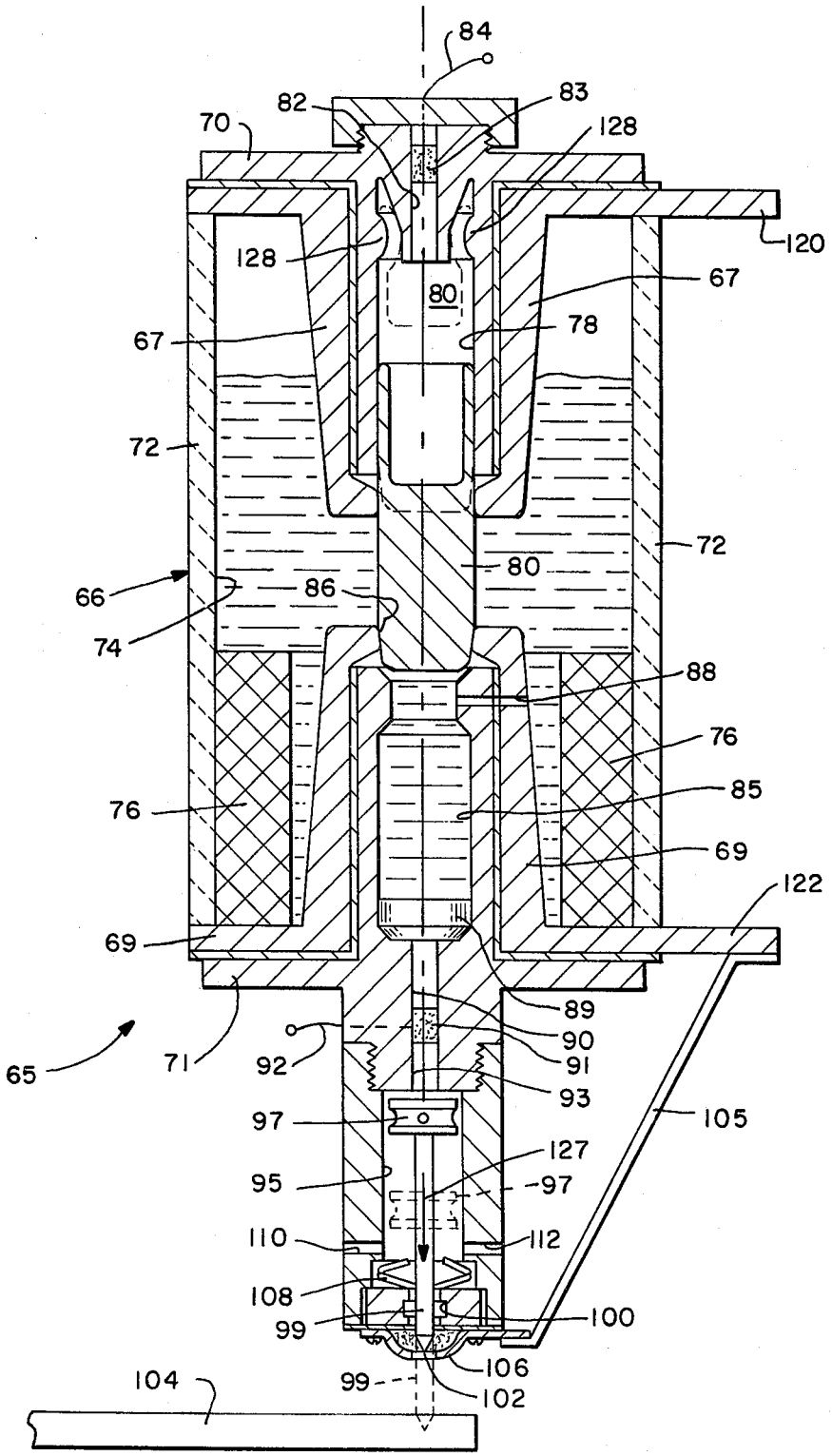
FIG. 6 is a cross-sectional view of an alternative embodiment of the switch of FIG. 1.

Another embodiment of the invention is shown in FIG. 6. In this embodiment, interrupter 65 includes a housing 66, which is substantially cylindrical in shape and encloses a pair of electrodes 67 and 69 supported by end walls 70 and 71, respectively. As in the first embodiment, cylindrical side walls 72 are formed of a suitable insulating material and the interior 74 is filled with dielectric fluid. Resilient foam members 76 are provided to absorb the fluid pressure pulses as in the first embodiment.

The central portion of upper electrode 67 surrounds a support chamber 78 which slidably supports a contact member 80 for movement between a closed position, shown with solid lines in FIG. 6, and an open position shown in phantom. AS in the first embodiment, contact 80 remains in conductive contact with electrode 67 at all times forming a movable portion of electrode 67. A first propellant receiving means 82, holds a suitable chemical propellant charge 83 at the upper end of cylinder 78. Charge 83 is detonated by a signal over wire 84.

The central portion of lower electrode 69 encloses fluid chamber 85, which holds the same dielectric fluid as does interior 74 of the housing. As in the first embodiment, chamber 85 has an opening which extends through opening 86 in electrode 69. Thus, the fluid in chamber 85 is adjacent contact 80 when the contact is in the closed position. Both side portions 87 of contact 80 and opening 86 are tapered to permit fluid to escape during contact closure, and a similar fluid escape is provided by way of passage 88. A first piston 89 is disposed in the lower portion of chamber 85, immediately above a second propellant receiving the means 90. A second chemical propellant charge 91 is placed in receiving means 90, and is detonated by a signal on wire 92. As in the first embodiment, the propellant charges are disposed on opposite sides along the axis of movement of contact 80 to drive the contact in opposite directions.

In this embodiment an additional cylinder provides external interconnection means below the second propellant charge. Cylinder 95 provides a suitable sliding support for second piston 97, which is connected to contact rod 99. Piston 97 is driven by charge 91 through a passage 93 which permits gasses from the charge to enter cylinder 95. Rod 99 extends exterior of the housing through opening 100 and forms interconnection means in the housing for electrically interconnecting electrode 69 with an external circuit. Such interconnection is accomplished when the tapered point 102 of rod 99 becomes embedded into external contact 104 which is preferably formed of soft aluminum or copper. Rod 99 is conductively connected with electrode 69 by means of bar 105 and contact 106. Alternatively, rod 99 could be connected to electrode 67. Cylinder 95 is filled with air or another suitable gas and the lower portion is cushioned by Belleville springs 108. Vent openings 110, and 112 are provided between cylinder 95 and the atmosphere. Piston 97 permits charge 91 to actuate an external interconnection means whenever the switch is opened.

Figure 7:
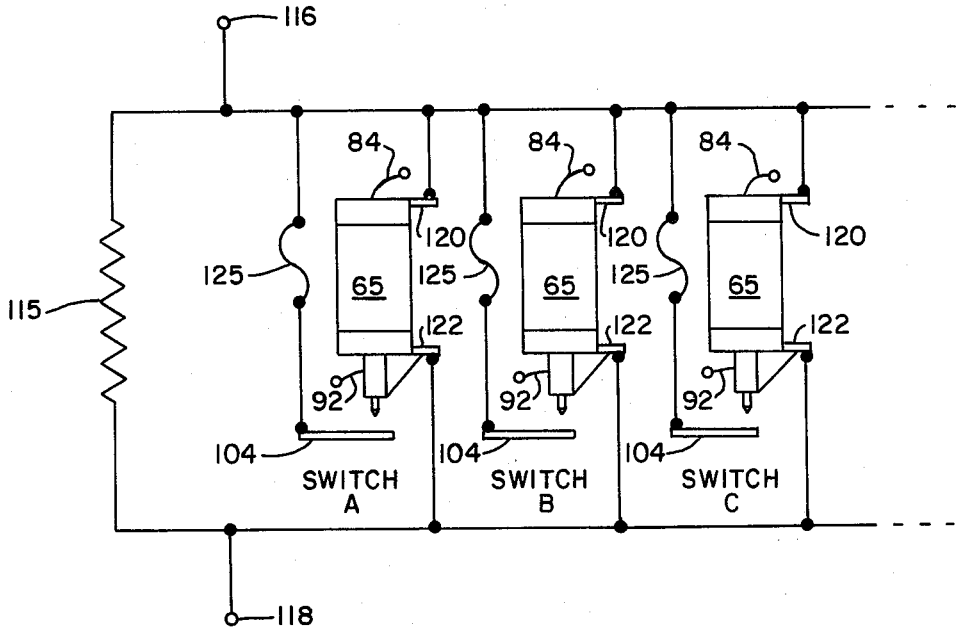
FIG. 7 is a circuit diagram showing the external connections for a plurality of switches of the type shown in FIG. 6.

Use of the switch of FIG. 6 is shown in FIG. 7, where a plurality of switches 65 are installed in parallel on a power distribution line. As with the first embodiment, a parallel current-suppressive impedance, represented by element 115, is installed in parallel between line connections 116 and 118. External portions 120 and 122 of electrodes 67 and 69, respectively, are connected to the power line. As before, detonation wires 84 and 92 are connected to a sequencing line-monitoring actuating means (not shown) which detonates the chemical propellants at the appropriate times. Unlike the first embodiment, an additional circuit element, such as fuse 125, is installed in parallel with each switch 65. External circuit 104 is connected to fuse 125.

In operation, during normal current levels, a single switch, Switch A for example, remains in the closed position carrying the line current. The remaining switches are in the open position. When the aforementioned actuating means detects a rapid rise in current level indicating a fault, a detonation signal is sent to Switch A over line 92, causing piston 89 to be driven against the fluid in chamber 85 and driving contact 80 upwardly, opening the switch. As in the first embodiment, the upper portions of contact 80 deform to lock the contact in the open position. The detonation of chemical propellant 91 also causes gas to enter the top of cylinder 95 through passage 93 adjacent piston 97, driving piston 97 and rod 99 downwardly in the direction of arrow 127 as shown in FIG. 6. When rod 99 becomes embedded in connector 104, fuse 125 is inserted on the line between points 116 and 118. The rapid insertion of fuse 125 will briefly reduce the arc current in the switch, facilitating arc extinction. In this way, the fault current can be more effectively diverted into parallel current suppressive impedance 115. The gasses in cylinder 95 eventually cool or escape by way of vents 110 and 112, causing Belleville springs 108 to raise rod 99. When rod 99 is separated from contact 104, the blown fuse 125 is removed rom the circuit to prevent possible shorting.

After the actuating means determines that the fault is cleared, a detonation signal is sent to Switch B over wire 84 to ignite the first propellant charge 83. Upon ignition, the gaseous pressure in cylinder 78 is substantially increased, driving contact 80 into the closed position shown with solid lines in FIG. 6. Line current then flows through Switch B until another fault is detected. As before, the actuating means automatically sequences through Switches A, B, C, etc. Approximately twenty of the switch-fuse pairs are assembled in a magazine for sequential firing. Switch 65 can be reused following replacement of the first and second propellant charges 83 and 90, and contact 80. Contact rod 99 might also require replacement, as would exterior contact 104 and fuse 125.

The embodiment shown in FIG. 6 provides the same rapid contact closure and opening as does the first embodiment. Similarly, a strong cross-flow of dielectric fluid is provided in the arcing region to increase the voltage drop produced by the switch. The insertion of fuse 125 onto the line will tend to increase the current-handling ability of Switch 65.

This invention provides switches of high reliability with a minimum number of moving parts. The use of chemical explosives accomplishes the switching functions faster than any known mechanical switch of comparable size. As with the interrupters shown in application Ser. No. 889, 491, filed Mar. 22, 1978, the switches of this invention provide for large voltage drops between the arcing electrodes and are extremely fast-acting.

Other embodiments of switches are possible within the scope of the invention. The electrodes may assume other shapes, for example. The movable electrode could be moved from the closed position into contact with a third internal electrode within the housing. The use of fluid and gaseous mediums between the propellant and the contact could be eliminated, and direct mechanical pressure-transmitting devices substituted. An example of such a mechanical connection is piston 97 and rod 99 shown in FIG. 6. Finally, both electrodes could be movable or include movable portions if alternative positioning of the propellants is employed.

A switch is provided for use in a current limiting circuit which is closed and opened by means of chemical propellants. The switch rapidly produces a large voltage drop between the electrodes upon opening. The switch can be reused with a minimum of reconstruction.

What is claimed is:

1. A chemically activated switch for use in controlling currents associated with power line faults comprising: a housing, a pair of relatively movable electrode members in said housing, said electrode members being movable between a closed position in which said electrode members are in mutual contact and an open position in which said electrode members are separated, first propellant receiving means disposed to drive said electrode members into said closed position upon detonation of a chemical propellant in said first propellant receiving means, second propellant receiving means disposed to drive said electrode members into said open position upon detonation of a chemical propellant in said second propellant receiving means, and a dielectric liquid in said housing for transmitting motive force from the vicinity of said second propellant receiving means to said electrode members to separate said electrode members.

2. A chemically activated switch as in claim 1 including a first chemical propellant charge in said first propellant receiving means and a second chemical propellant charge in said second propellant receiving means, said first propellant charge being relatively smaller than said second propellant charge whereby the force provided to drive said electrode members into said open position exceeds the force provided to drive said electrode members into said closed position.

3. A chemically activated switch as in claim 1 further including interconnection means in said housing for electrically interconnecting one of said electrode members with a circuit external of said housing upon detonation of a chemical propellant in said second propellant receiving means.

4. A chemically activated switch as in claim 1 including means forming a chamber in said housing having an opening into said housing, at least one said electrode member being movable to block and close said opening when said electrode members are in said closed position, said chamber having said dielectric liquid therein, and said second propellant receiving means being disposed in said chamber whereby detonation of a chemical propellant in said second propellant receiving means will cause an increase in pressure of said dielectric liquid in said chamber and move said electrode members from said closed position.

5. A chemically activated switch for use in controlling currents associated with power line faults comprising: a housing, an electrode member in said housing, a contact member supported in said housing for movement between a closed position in which said contact member contacts said electrode member to complete an electrical circuit and an open position in which said contact member is separated from said electrode member, a first propellant receiving means in said housing for driving said contact member into said closed position upon detonation of a chemical propellant in said first propellant receiving means, a second propellant receiving means in said housing for driving said contact member into said open position upon detonation of a chemical propellant in said second propellant receiving means, and a dielectric liquid in said housing for transmitting motive force from the vicinity of said second propellant receiving means to said contact member to move said contact member into said open position.

6. A chemically activated switch as in claim 5 in which said means for transmitting motive force includes means forming a chamber in said housing for holding a portion of said dielectric fluid, said chamber having an opening adjacent said contact member when said contact member is in said closed position, and a movable first piston in said chamber, said first piston being disposed between said second propellant receiving means and said dielectric fluid in said chamber.

7. A chemically activated switch as in claim 6 in which said chamber extends adjacent said electrode member and said electrode member includes an opening therethrough forming an extension of said chamber opening, said contact member blocking and closing said opening when in said closed position.

8. A chemically activated switch as in claim 5 including a support cylinder in said housing in which said contact member is slidably supported for movement, said first propellant receiving means being being disposed in said support cylinder.

9. A chemically activated switch as in claim 8 in which said support cylinder contains a gaseous medium for transmitting motive force from said first propellant receiving means to said contact member.

10. A chemically activated switch as in claim 9 including a first chemical propellant charge in said first propellant receiving means for substantially increasing the gaseous pressure in said support cylinder to drive said contact member into said closed position, and a second chemical propellant charge relatively larger than said first chemical propellant charge in said second propellant receiving means whereby the force provided upon detonation of said second chemical propellant charge is sufficient to overcome the gaseous pressure in said support cylinder and drive said contact member into said open position.

11. A chemically activated switch as in claim 5 further including interconnection means in said housing for electrically interconnecting one of either said contact member or said electrode member with a circuit external of said housing upon detonation of a chemical propellant in said second propellant receiving means.

12. A chemically activated switch as in claim 5 including means forming a chamber in said housing having an opening into said housing, said contact member blocking and closing said opening when in said closed position, said chamber having said dielectric liquid therein, and said second propellant receiving means being disposed in said chamber whereby detonation of a chemical propellant in said second propellant receiving means will cause an increase in pressure of said dielectric liquid in said chamber and move said contact member into said open position.

13. A chemically activated switch for use in controlling currents associated with power line faults comprising: a housing, an electrode member in said housing, a support cylinder in said housing, a contact member slidably supported in said support cylinder for movement between a closed position in which said contact member contacts said electrode member to complete an electrical circuit and an open position in which said contact member is separated from said electrode member, a first propellant receiving means in said support cylinder for driving said contact member into said closed position upon detonation of a chemical propellant in said first propellant receiving means, means forming a chamber in said housing for holding dielectric fluid, said chamber having an opening adjacent said contact member when said contact member is in said closed position, a first piston in said chamber, and a second propellant receiving means for driving said first piston against said dielectric fluid in said chamber upon detonation of a chemical propellant in said second propellant receiving means thereby to drive said contact member into said open position by means of fluid pressure.

14. A chemically activated switch as in claim 13 in which said chamber extends adjacent said electrode member and said electrode member includes an opening therethrough forming an extension of said chamber opening, said contact member blocking and closing said opening when in said closed position.

15. A chemically activated switch as in claim 13 further including interconnection means in said housing for electrically interconnecting one of either said contact member or said electrode member with a circuit external of said housing upon detonation of a chemical propellant in said second propellant chamber, and a passage in said housing between said second propellant receiving means and said interconnection means to permit chemical propellant in said second propellant receiving means to actuate said interconnection means by means of said passage.

16. A chemically activated switch as in claim 15 in which said interconnection means in said housing includes a second piston in said housing adjacent said passage, and a conductive contact rod connected to said second piston, said contact rod being extended exterior of said housing upon detonation of a chemical propellant in said second propellant receiving means.

17. A chemically activated switch for use in controlling currents associated with power line faults comprising: a housing, a pair of relatively movable electrode members in said housing, one of said electrode members being a contact member supported in said housing for movement along an axis of movement into contact with the other of said electrode members when said electrode members are in a closed position, said contact member also being movable to an open position in which said electrode members are separated, first propellant receiving means disposed along said axis of movement on one side of said contact member to drive said contact member into said closed position upon detonation of a chemical propellant in said first propellant receiving means, second propellant receiving means disposed along said axis movement on the opposite side of said contact member to drive said contact member into said open position upon detonation of a chemical propellant in said second propellant receiving means, a gaseous medium in said housing between said first propellant receiving means and said contact member, and a fluid medium in said housing disposed between said second propellant receiving means and said contact member, said gaseous and fluid mediums transmitting motive force to said contact member from chemical propellant charges in said first and second propellant receiving means.

18. A chemically activated switch for use in controlling currents associated with power line faults comprising: a housing, an electrode member in said housing, a contact member supported in said housing for movement between a closed position in which said contact member contacts said electrode member to complete an electrical circuit and an open position in which said contact member is separated from said electrode member, a first propellant receiving means in said housing for driving said contact member into said closed position upon detonation of a chemical propellant in said first propellant receiving means, a second propellant receiving means in said housing for driving said contact member into said open position upon detonation of a chemical propellant in said second propellant receiving means, said housing being substantially filled with a dielectric fluid, means forming a chamber in said housing for holding a portion of said dielectric fluid, said chamber having an opening adjacent said contact member when said contact member is in said close position, and a movable first piston in said chamber, said first piston being disposed between said second propellant receiving means and said dielectric fluid in said chamber whereby motive force from said second propellant receiving means is transmitted to said contact member through said opening by means of said first piston and said dielectric fluid.

19. A chemically activated switch as in claim 18 in which said chamber extends adjacent said electrode member and said electrode member includes an opening therethrough forming an extension of said chamber opening, said contact member blocking and closing said opening when in said closed position.

20. A chemically activated switch for use in controlling currents associated with power line faults comprising: a housing, an electrode member in said housing, a support cylinder in said housing, a contact member supported for slidable movement in said support cylinder between a closed position in which said contact member contacts said electrode member to complete an electrical circuit and an open position in which said contact member is separated from said electrode member, first propellant receiving means disposed in said support cylinder for driving said contact member into said closed position upon detonation of a chemical propellant in said first propellant receiving means, second propellant receiving means in said housing for driving said contact member into said open position upon detonation of a chemical propellant in said second propellant receiving means, and a dielectric liquid in said housing for transmitting motive force from the vicinity of said second propellant receiving means against said contact member to move said contact member into said open position by means of fluid pressure.

21. A chemically activated switch as in claim 20 in which said support cylinder contains a gaseous medium for transmitting motive force from said first propellant receiving means to said contact member.

22. A chemically activated switch as in claim 21 including a first chemical propellant charge in said first propellant receiving means for substantially increasing the gaseous pressure in said support cylinder to drive said contact member into said closed position, and a second chemical propellant charge relatively larger than said first chemical propellant charge in said second propellant receiving means whereby the force provided upon detonation of said second chemical propellant charge is sufficient to overcome the gaseous pressure in said support cylinder and drive said contact member into said open position.

* * * * *